US010615525B1

(12) United States Patent
Lin et al.

(10) Patent No.: US 10,615,525 B1
(45) Date of Patent: Apr. 7, 2020

(54) ELECTRONIC DEVICE WITH CONDUCTIVE STRUCTURE DIRECTLY ABUTTING METAL FRAME TO GROUND BRACKET

(71) Applicant: Wistron NeWeb Corp., Hsinchu (TW)

(72) Inventors: Yi-Chieh Lin, Hsinchu (TW); San-Yi Kuo, Hsinchu (TW); Man-Ning Lu, Hsinchu (TW); Cheng-Hsiung Lu, Hsinchu (TW); Huei-Chi Wu, Hsinchu (TW); Yu-Cheng Yu, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 0 days.

(21) Appl. No.: 16/585,533

(22) Filed: Sep. 27, 2019

(30) Foreign Application Priority Data

Nov. 8, 2018 (TW) ..... 107139641 A

(51) Int. Cl.

| | |
|---|---|
| ***H01R 12/70*** | (2011.01) |
| ***H01R 24/62*** | (2011.01) |
| ***H01R 13/6471*** | (2011.01) |
| ***H01R 13/73*** | (2006.01) |
| *H01R 107/00* | (2006.01) |

(52) U.S. Cl.
CPC ..... *H01R 12/7011* (2013.01); *H01R 13/6471* (2013.01); *H01R 13/73* (2013.01); *H01R 24/62* (2013.01); *H01R 2107/00* (2013.01)

(58) Field of Classification Search
CPC ..... H01R 13/6471; H01R 13/73; H01R 12/7011; H01R 24/62; H01R 12/718
USPC ..... 439/78, 607.27
See application file for complete search history.

(56) References Cited

U.S. PATENT DOCUMENTS

| | | | | |
|---|---|---|---|---|
| 6,315,608 | B1 * | 11/2001 | Lopata | H01R 13/6585 439/607.36 |
| 6,447,311 | B1 * | 9/2002 | Hu | H01R 13/658 439/108 |
| 7,044,790 | B2 * | 5/2006 | Zhu | H01R 13/6583 439/541.5 |
| 7,059,915 | B1 | 6/2006 | Schempp et al. | |
| 7,077,696 | B2 | 7/2006 | Haga et al. | |
| 7,104,842 | B1 * | 9/2006 | Huang | H01R 13/6594 439/607.55 |

(Continued)

FOREIGN PATENT DOCUMENTS

| | | |
|---|---|---|
| CN | 1677764 A | 10/2005 |
| TW | I323532 A | 4/2010 |
| TW | M434318 U1 | 7/2012 |

*Primary Examiner* — Hae Moon Hyeon
*Assistant Examiner* — Peter G Leigh
(74) *Attorney, Agent, or Firm* — McClure, Qualey & Rodack, LLP

(57) ABSTRACT

An electronic device is provided. The electronic device includes a substrate, a connector, a ground bracket and a conductive structure. The substrate includes a ground layer. The connector is disposed on the substrate, wherein the connector includes a metal frame. The ground bracket is affixed on the substrate and coupled to the ground layer, wherein at least a portion of the connector is located in the ground bracket. The conductive structure is adapted to abut the metal frame and to abut the ground bracket, wherein when the conductive structure connects the metal frame to the ground bracket, the conductive structure electrically connects the ground bracket to the metal frame.

17 Claims, 10 Drawing Sheets

(56) References Cited

U.S. PATENT DOCUMENTS

| | | | | |
|---|---|---|---|---|
| 7,351,106 | B2 * | 4/2008 | Zhu | H01R 12/716 439/377 |
| 7,744,418 | B2 * | 6/2010 | He | H01R 13/658 439/607.35 |
| 7,811,131 | B2 * | 10/2010 | Wang | H01R 12/714 439/607.35 |
| 7,824,219 | B2 * | 11/2010 | Wang | H01R 13/6582 439/607.27 |
| 7,828,598 | B2 * | 11/2010 | Wang | H01R 13/502 439/607.27 |
| 8,033,868 | B2 * | 10/2011 | Wang | H01R 24/60 439/660 |
| 8,109,791 | B2 * | 2/2012 | Kameyama | H01R 23/6873 439/607.37 |
| 8,215,995 | B1 | 7/2012 | Little et al. | |
| 8,535,097 | B2 * | 9/2013 | Yen | H01R 13/6594 439/607.27 |
| 8,684,769 | B2 * | 4/2014 | Kao | H01R 13/6471 439/607.28 |
| 8,920,197 | B2 * | 12/2014 | Tziviskos | H01R 13/405 439/660 |
| 9,281,625 | B2 * | 3/2016 | Kao | H01R 13/6471 |
| 9,496,665 | B2 * | 11/2016 | Do | H01R 24/62 |
| 2011/0045692 | A1 | 2/2011 | Westman et al. | |
| 2011/0151705 | A1 | 6/2011 | Kagotani | |
| 2016/0079713 | A1 * | 3/2016 | Yu | H01R 13/6582 439/607.27 |
| 2016/0268744 | A1 * | 9/2016 | Little | H01R 24/60 |

* cited by examiner

E

4

ELECTRONIC DEVICE WITH CONDUCTIVE STRUCTURE DIRECTLY ABUTTING METAL FRAME TO GROUND BRACKET

CROSS REFERENCE TO RELATED APPLICATIONS

This Application claims priority of Taiwan Patent Application No. 107139641, filed on Nov. 8, 2018, the entirety of which is incorporated by reference herein.

BACKGROUND OF THE INVENTION

Field of the Invention

The present invention relates to an electronic device, and in particular to an electronic device with a connector.

Description of the Related Art

Given the increased quantity of data transmissions, an electro-magnetic wave is generated when a conventional high-definition multimedia interface (HDMI) connector performs a high-speed transmission. The electro-magnetic wave causes noise interference, and dramatically decreases the signal transmission speed. Even when a conventional high- definition multimedia interface (HDMI) connector is encased in a metal housing, the problem of noise interference still cannot be properly solved.

BRIEF SUMMARY OF THE INVENTION

In one embodiment, an electronic device is provided. The electronic device includes a substrate, a connector, a ground bracket and a conductive structure. The substrate includes a ground layer. The connector is disposed on the substrate, wherein the connector comprises a metal frame. The ground bracket is affixed on the substrate and coupled to the ground layer, wherein at least a portion of the connector is located in the ground bracket. The conductive structure is adapted to abut the metal frame and to abut the ground bracket, wherein when the conductive structure connects the metal frame to the ground bracket, the conductive structure electrically connects the ground bracket to the metal frame.

In the embodiment of the invention, by covering the connector with the ground bracket, the noise of the connector can be reduced. Particularly, the conductive structure couples the metal frame of the connector and the ground bracket, and the resistance between the metal frame and the ground bracket is decreased by the conductive structure. The additional surface current on the metal frame can be conducted to the ground bracket fast, and the noise interference can be reduced. According to experimental result, the electronic device utilizing the embodiment of the invention, the signal attenuation ratio is reduced to 20% from 40%.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
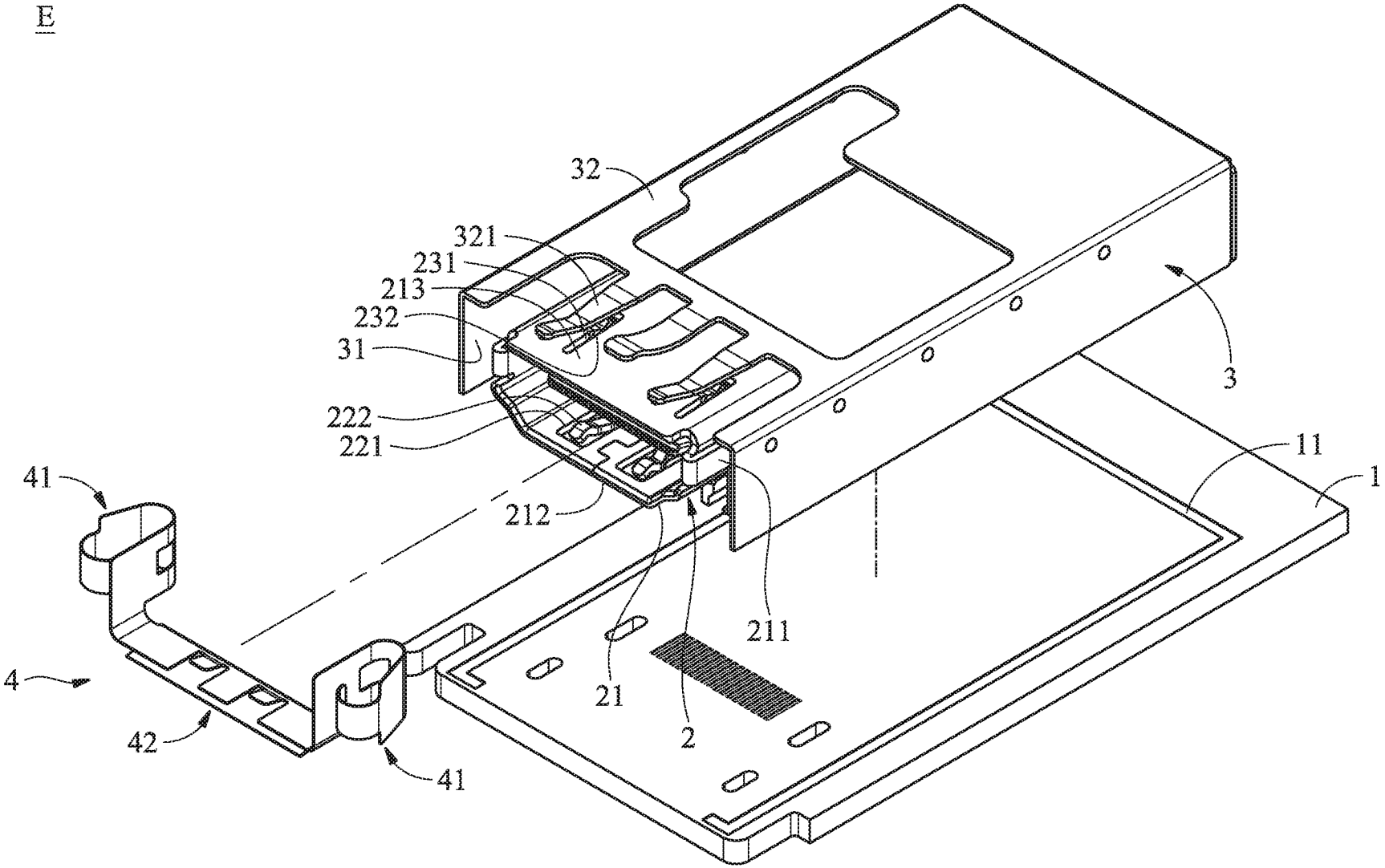
FIG. 1A is an exploded view of a portion of an electronic device of an embodiment of the invention.
Figure 1B:
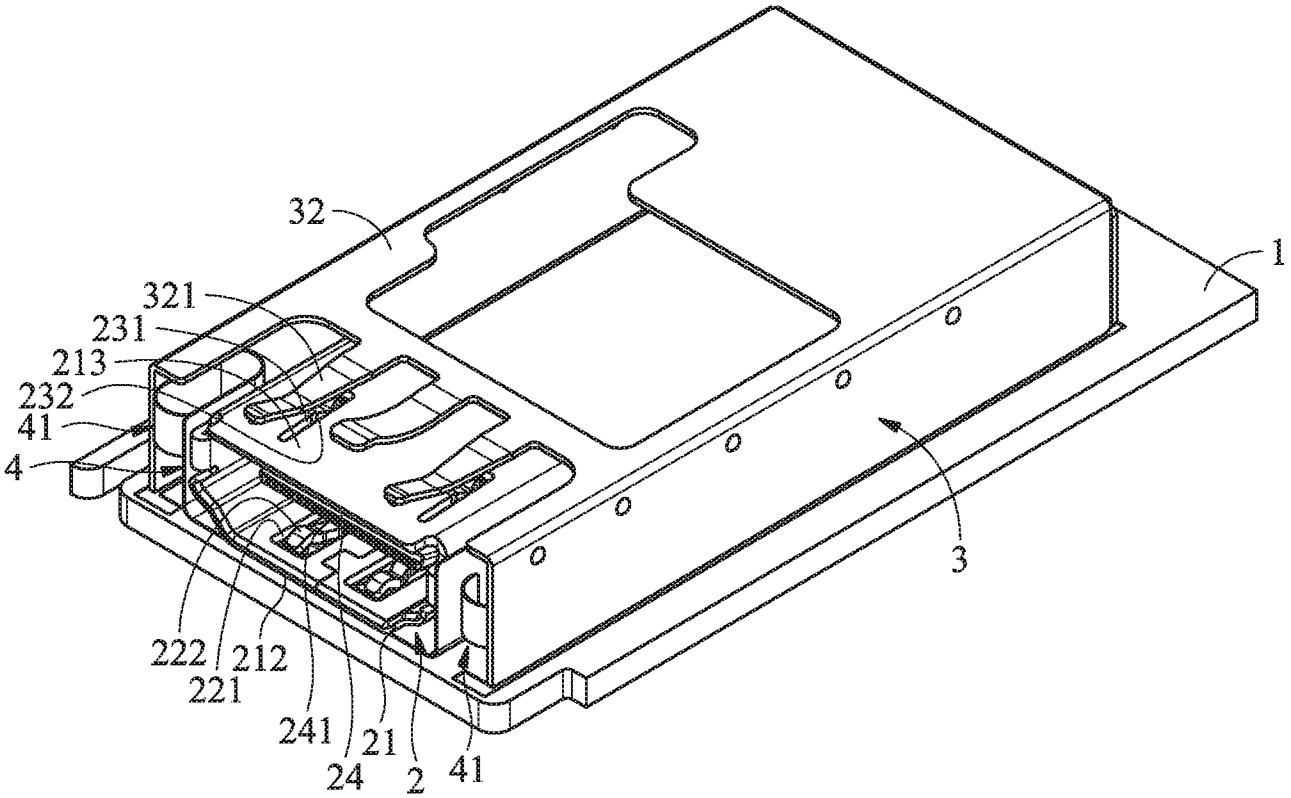
FIG. 1B is an assembled view of a portion of the electronic device of the embodiment of the invention.

FIG. 1A is an exploded view of a portion of an electronic device of an embodiment of the invention. FIG. 1B is an assembling view of a portion of the electronic device of the embodiment of the invention. With reference to FIGS. 1A and 1B, the electronic device E of the first embodiment of the invention includes a substrate 1, a connector 2, a ground bracket 3 and a conductive structure 4. The substrate 1 includes a ground layer 11. The connector 2 is disposed on the substrate 1, wherein the connector 2 comprises a metal frame 21. The ground bracket 3 is affixed on the substrate 1 and coupled to the ground layer 11. The connector 2 is located in the ground bracket 3. In other words, the metal frame 21 of the connector 2 is aligned with a side of the ground bracket 3 or behind the side of the ground bracket 3. In another embodiment, only a portion of the connector 2 is located in the ground bracket 3. The conductive structure 4 is adapted to be inserted into the space between the metal frame 21 and the ground bracket 3, and abut the metal frame 21 and the ground bracket 3. When the conductive structure 4 abuts the metal frame 21 and the ground bracket 3 at the same time, the conductive structure 4 electrically connects the ground bracket 3 to the metal frame 21.

Figure 2A:
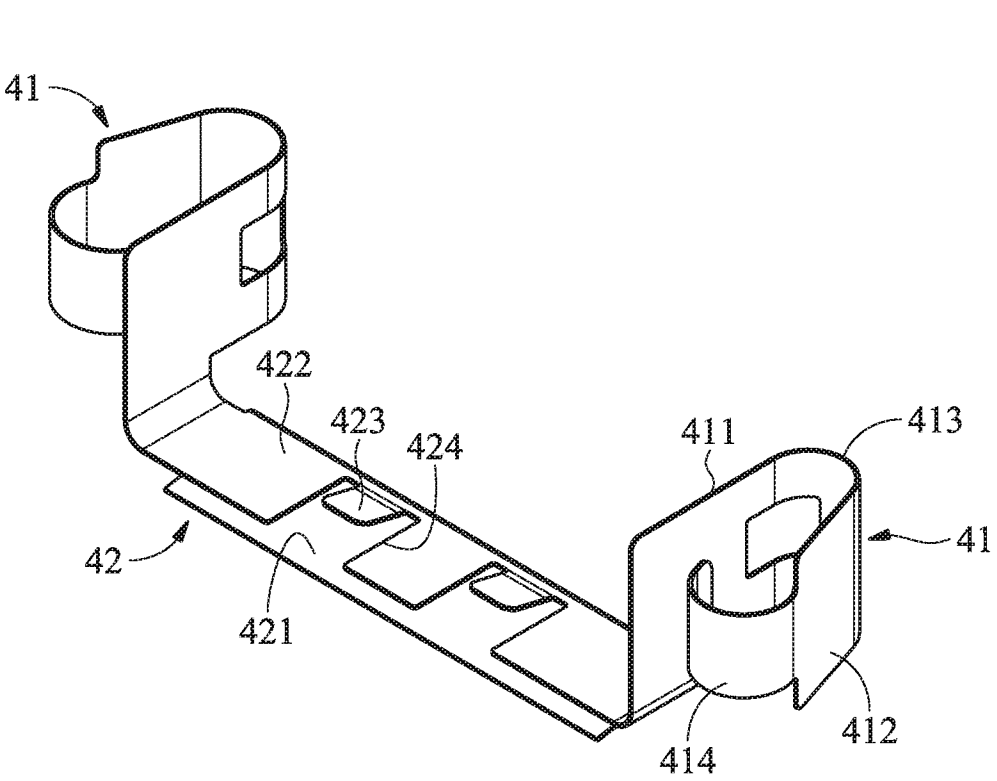
FIG. 2A is a perspective view of a conductive structure of the embodiment of the invention.
Figure 3A:
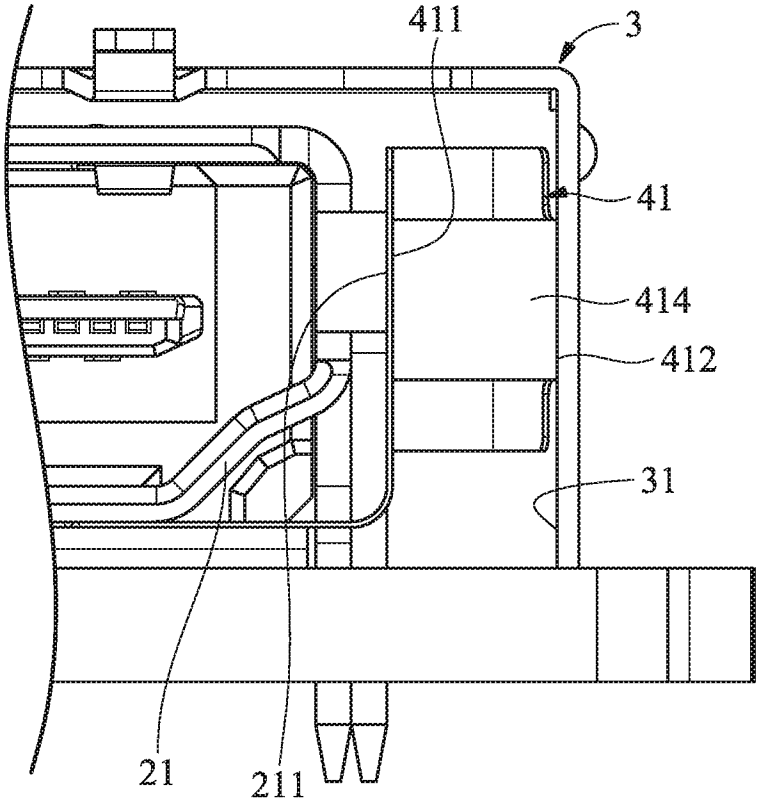
FIG. 3A shows a first elastic abutting unit being electrically connected to a ground bracket and a metal frame of the embodiment of the invention.

FIG. 2A shows details of the conductive structure of the embodiment of the invention, wherein the conductive structure 4 includes at least one first elastic abutting unit 41. FIG. 3A shows the first elastic abutting unit being electrically connected to the ground bracket and the metal frame. With reference to FIGS. 2A and 3A, in one embodiment, the ground bracket 3 comprises at least one ground bracket wall 31. The metal frame 21 comprises a metal frame lateral side 211. The ground bracket wall 31 faces the metal frame lateral side 211. When the conductive structure 4 is connected to the metal frame 21 and the ground bracket 3, the first elastic abutting unit 41 is located between the metal frame 21 and the ground bracket 3, and the first elastic abutting unit 41 is connected to the ground bracket wall 31 and the metal frame lateral side 211 at the same time.

Therefore, the first elastic abutting unit 41 decreases the resistance between the ground bracket wall 31 and the metal frame lateral side 211.

With reference to FIG. 2A, in one embodiment, the first elastic abutting unit 41 comprises a first abutting portion 411, a first curved portion 413 and a second abutting portion 412. The first abutting portion 411 is disposed on one end of the first curved portion 413. The second abutting portion 412 is disposed on the other end of the first curved portion 413. When the first elastic abutting unit 41 is located between the metal frame 21 and the ground bracket 3, the first abutting portion 411 is connected to the metal frame lateral side 211, and the second abutting portion 412 is connected to the ground bracket wall 31.

Figure 2B:
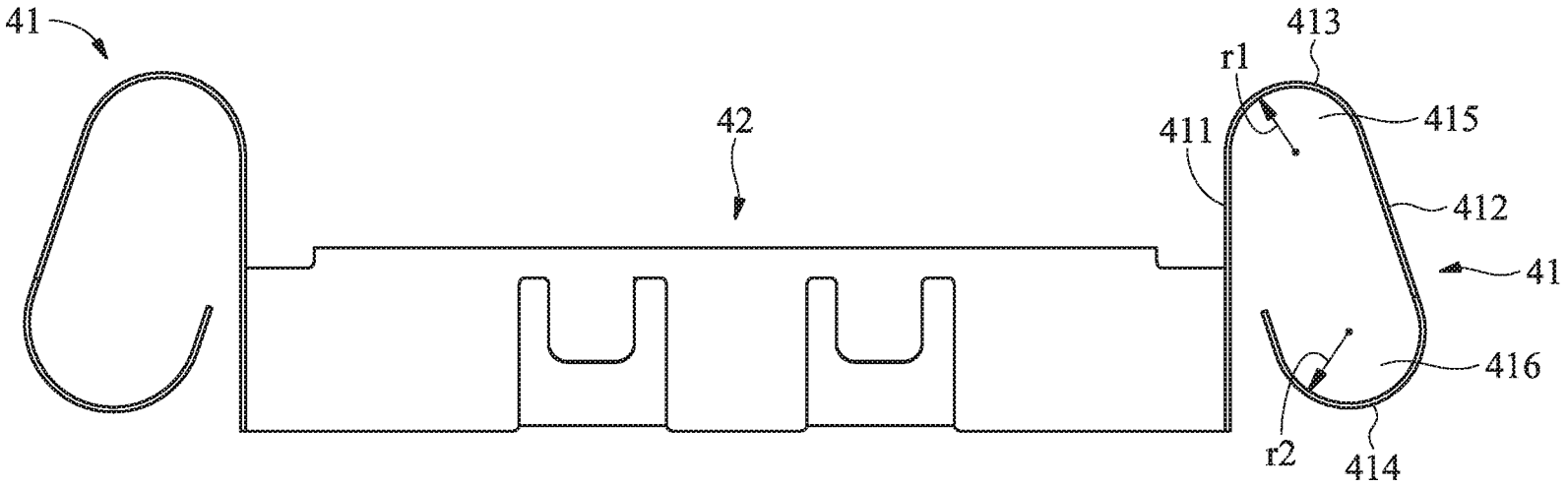
FIG. 2B is a top view of the conductive structure of the embodiment of the invention.

With reference to FIG. 2A, in one embodiment, the first elastic abutting unit 41 further comprises a second curved portion 414. One end of the second abutting portion 412 is connected to the first curved portion 413. The second curved portion 414 is connected to the other end of the second abutting portion 412. With reference to FIG. 2B, the first curved portion 413 forms a first recess 415, the second curved portion 414 forms a second recess 416, and the first recess 415 and the second recess 416 face each other.

With reference to FIGS. 2A, 2B and 3A, in one embodiment, when the conductive structure 4 is separated from the metal frame 21 and the ground bracket 3, the second curved portion 414 is separated from the first abutting portion 411. When the first elastic abutting unit 41 is located between the metal frame 21 and the ground bracket 3, the second curved portion 414 abuts the first abutting portion 411. In this embodiment, the first curved portion 413 has a first curvature radius r1, the second curved portion 414 has a second curvature radius r2, and the second curvature radius r2 is greater than the first curvature radius r1. Utilizing the design of the second curvature radius r2 being greater than the first curvature radius r1, the first elastic abutting unit 41 provides turning function at the first curved portion 413, and provides elastic abutting function at the second curved portion 414. Particularly, the elastic provided by the second curved portion 414 makes the first elastic abutting unit 41 more sufficiently contact the ground bracket wall 31 and the metal frame lateral side 211. The resistance between the ground bracket wall 31 and the metal frame lateral side 211 is therefore decreased.

In one embodiment, when the conductive structure 4 connects the metal frame 21 to the ground bracket 3, a virtual extension line of the first abutting portion 411 is parallel to a virtual extension line of the second abutting portion 412. However, the disclosure is not meant to restrict the invention. In another embodiment, an included angle between the virtual extension line of the first abutting portion 411 and the virtual extension line of the second abutting portion 412 can be less than 5 degrees.

Figure 4A:
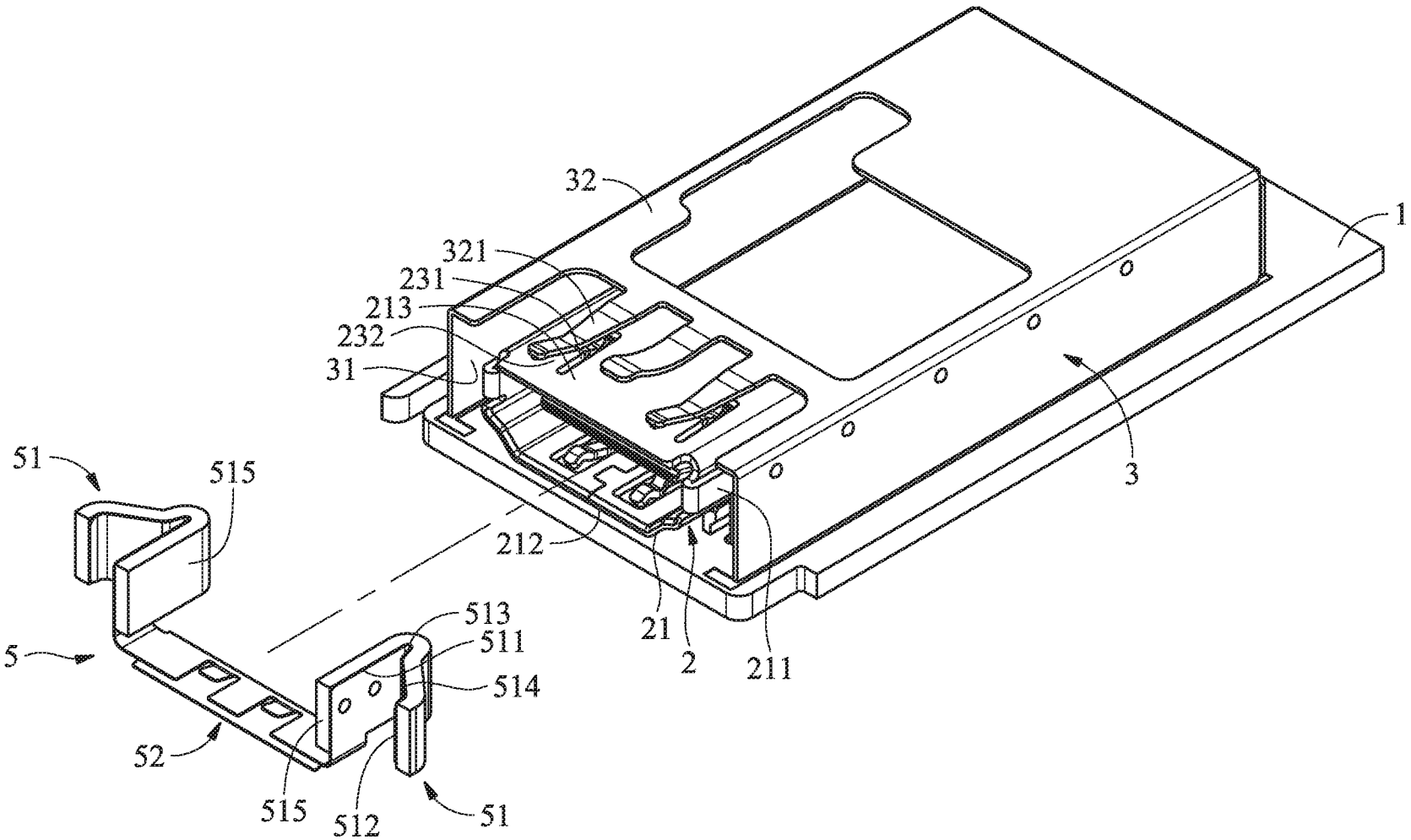
FIG. 4A is an exploded view of a portion of a conductive structure of another embodiment of the invention.
Figure 4B:
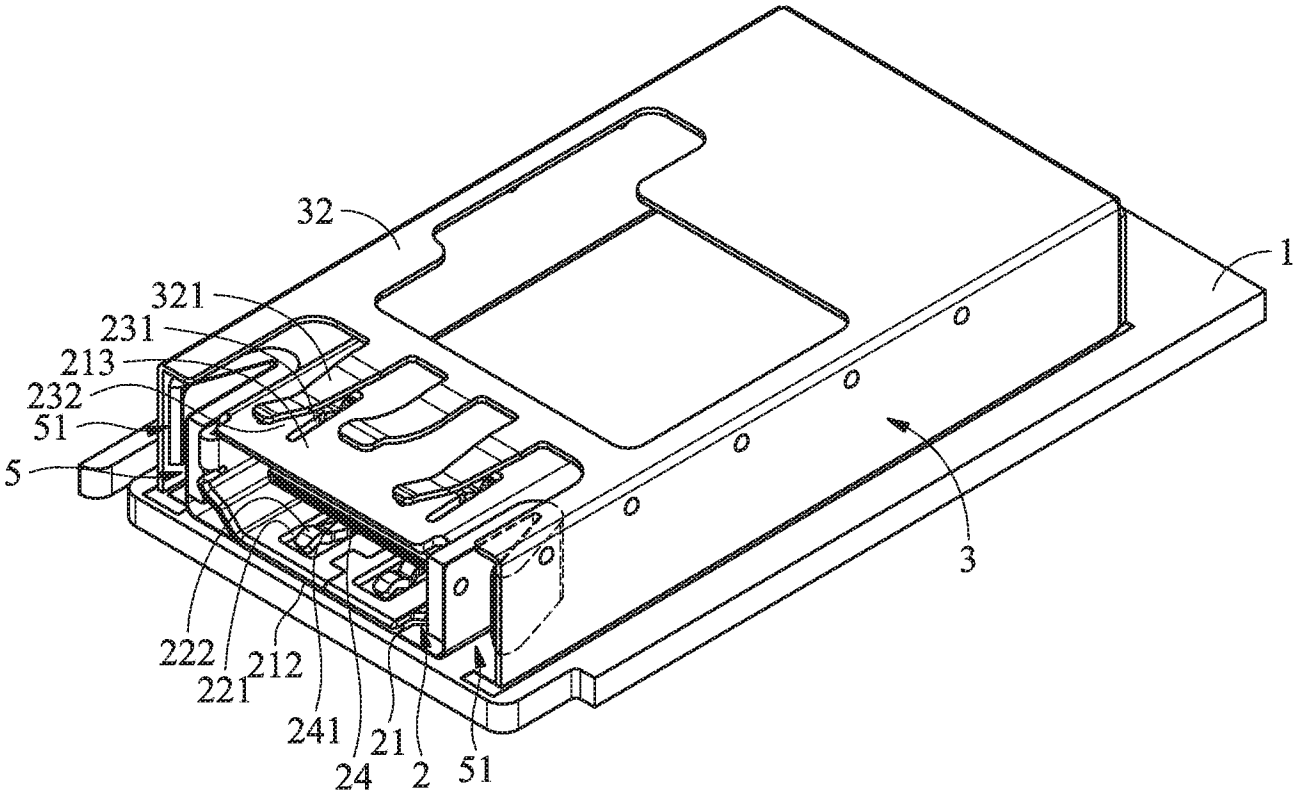
FIG. 4B is an assembling view of a portion of the conductive structure of the embodiment of FIG. 4A.

FIGS. 4A and 4B show a conductive structure 5 of another embodiment of the invention. In this embodiment, the first elastic abutting unit 51 comprises a first abutting portion 511, a curved portion 513, an extending portion 514 and a second abutting portion 512. The curved portion 513 connects the first abutting portion 511 to the extending portion 514. The extending portion 514 connects the curved portion 513 to the second abutting portion 512. The first elastic abutting unit 51 is V-shaped. One end of the second abutting portion 512 is substantially parallel to the first abutting portion 511. When the first elastic abutting unit 51 is located between the metal frame 21 and the ground bracket 3, the first abutting portion 511 is connected to the metal frame lateral side 211, and the second abutting portion 512 is connected to the ground bracket wall 31.

With reference to FIGS. 4A and 4B, in one embodiment, the first elastic abutting unit 51 further comprises conductive foam 515. The conductive foam 515 is adapted to be attached to the first abutting portion 511 and the second abutting portion 512. The conductive foam 515 increases conductive area and decreases resistance.

In one embodiment, conductive foam can also be disposed on the first elastic abutting unit 41, and the first elastic abutting unit 41 can be connected to the ground bracket wall 31 and the metal frame lateral side 211 via the conductive foam. In another embodiment, the conductive foam on the first elastic abutting unit 51 can be removed, and the first abutting portion 511 directly abuts the metal frame lateral side 211, and the second abutting portion 512 directly abuts the ground bracket wall 31. The disclosure is not meant to restrict the invention.

With reference to FIGS. 1A and 1B, in one embodiment, the metal frame 21 comprises a metal frame bottom side 212. The metal frame bottom side 212 faces the substrate 1. The conductive structure 4 comprises a second elastic abutting unit 42. The second elastic abutting unit 42 is connected to the first elastic abutting unit 41. When the conductive structure 4 connects the metal frame 21 to the ground bracket 3, the second elastic abutting unit 42 is located between the metal frame bottom side 212 and the substrate 1, the second elastic abutting unit 42 is connected to the metal frame bottom side 212 and the substrate 1 at the same time, and the second elastic abutting unit 42 electrically connects the metal frame bottom side 212 to the first elastic abutting unit 41. Therefore, the second elastic abutting unit 42 decreases the resistance between the metal frame bottom side 212 and the ground bracket wall 31.

In this embodiment, there are two first elastic abutting units 41. The first elastic abutting units 41 are connected to the two sides of the second elastic abutting unit 42. Each elastic abutting unit 41 is connected to the second elastic abutting unit 42 via a bending portion, and a bending angle of the bending portion is about 90 degrees.

Figure 3B:
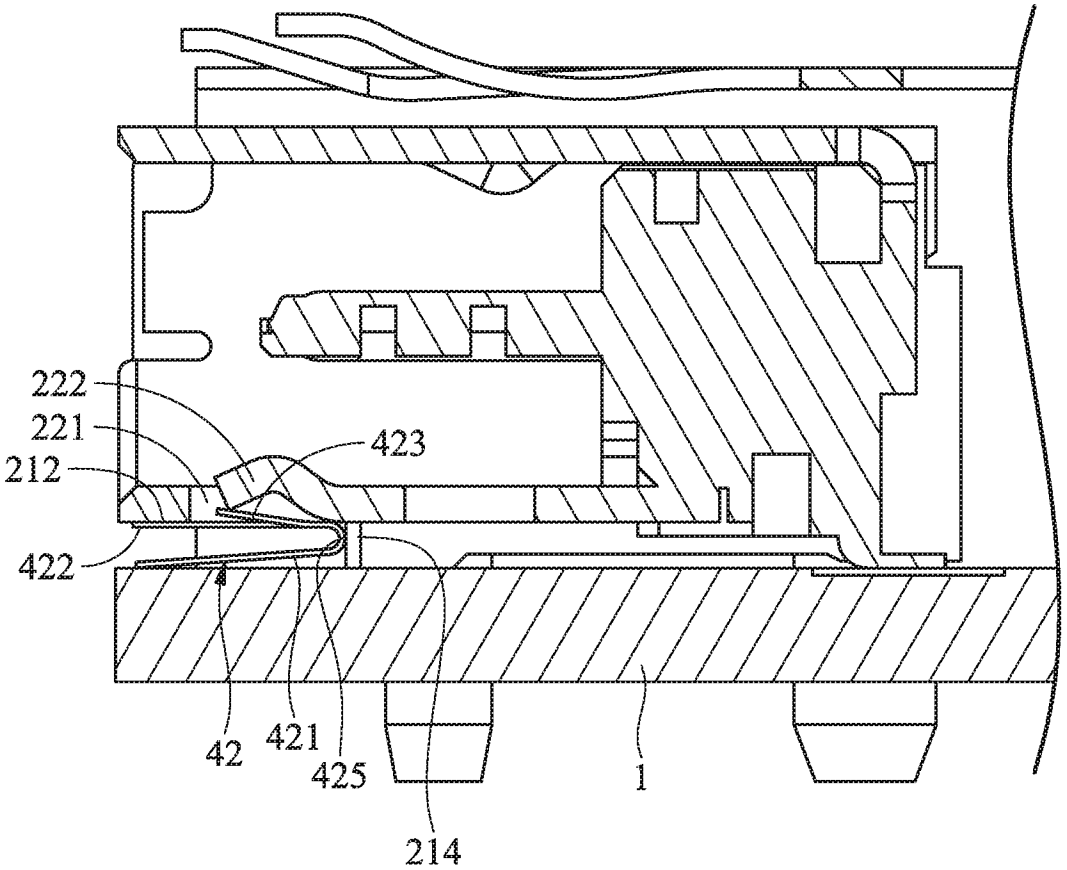
FIG. 3B shows a second elastic abutting unit being electrically connected to the ground bracket and the metal frame of the embodiment of the invention.

With reference to FIGS. 1A and 1B, in one embodiment, the metal frame bottom side 212 comprises at least one first groove 221 and at least one first metal frame elastic arm 222. The first metal frame elastic arm 222 is in the first groove 221. With reference to FIG. 2A, the second elastic abutting unit 42 comprises a third abutting portion 421, a fourth abutting portion 422 and at least one elastic sheet 423. The third abutting portion 421 is connected to the fourth abutting portion 422. The elastic sheet 423 is disposed on the fourth abutting portion 422. With reference to FIG. 3B, when the second elastic abutting unit 42 is located between the metal frame bottom side 212 and the substrate 1, the third abutting portion 421 abuts the substrate 1, and the elastic sheet 423 is located in the first groove 221 and is adapted to abut the first metal frame elastic arm 222. Therefore, the elastic sheet 423 sufficiently contact the first metal frame elastic arm 222, and the resistance between the metal frame bottom side 212 and the ground bracket wall 31 is reduced.

With reference to FIGS. 2A and3B, in one embodiment, when the second elastic abutting unit 42 is located between the metal frame bottom side 212 and the substrate 1, the fourth abutting portion 422 abuts the metal frame bottom side 212. The fourth abutting portion 422 has an abutting portion notch 424, and the elastic sheet 423 is located in the abutting portion notch 424.

With reference to FIGS. 2A and 3B, in one embodiment, the third abutting portion 421 is sheet-shaped. The fourth abutting portion 422 is sheet-shaped. The first elastic abutting unit 41 is connected to the fourth abutting portion 422. A cross section of the second elastic abutting unit 42 is V-shaped (FIG. 3B).

Figure 3C:
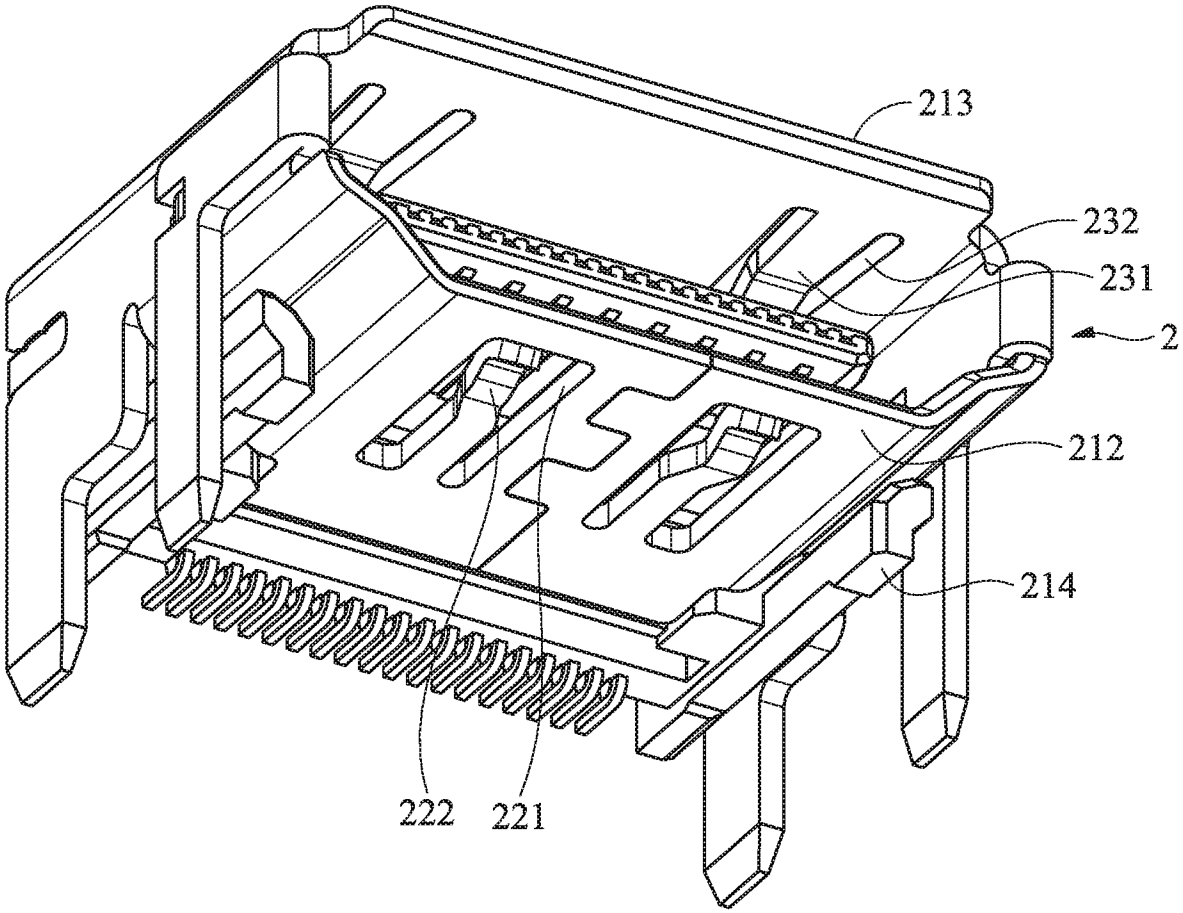
FIG. 3C shows details of the metal frame of the embodiment of the invention.

FIG. 3C shows details of the metal frame of the embodiment of the invention. With reference to FIGS. 3B and 3C, in one embodiment, the metal frame 21 has a leaning portion 214. One side of the leaning portion 214 abuts the substrate 1. The top point 425 of the V-shaped second elastic abutting unit 42 abuts the other side of the leaning portion 214. Therefore, the conductive structure 4 is prevented from being inserted between the metal frame 21 and the ground bracket 3 too deeply.

With reference to FIGS. 2A and 3B, in one embodiment, when the second elastic abutting unit 42 is located between the metal frame bottom side 212 and the substrate 1, the second elastic abutting unit 42 covers the first groove 221 to prevent noise from leaking.

With reference to FIG. 2A, in one embodiment, the conductive structure 4 is integrally formed, which can be formed by punching. However, the disclosure is not meant to restrict the invention. In another embodiment, the conductive structure 4 can be made by a plurality of elements.

With reference to FIGS. 1A and 1B, in one embodiment, the metal frame 21 comprises a metal frame top side 213. The metal frame top side 213 is opposite to the metal frame bottom side 212. The ground bracket 3 comprises a bracket covering portion 32. The bracket covering portion 32 covers at least a portion of the metal frame top side 213.

With reference to FIGS. 1A and 1B, in one embodiment, the metal frame top side 213 comprises at least one second groove 231 and at least one second metal frame elastic arm 232. The second metal frame elastic arm 232 is located in the second groove 231. The bracket covering portion 32 comprises a bracket elastic arm 321. The bracket elastic arm 321 is adapted to abut the second metal frame elastic arm 323 to electrically connect the metal frame 21 and the ground bracket 3. Therefore, the resistance between the metal frame 21 and the ground bracket 3 is decreased.

Figure 1C:
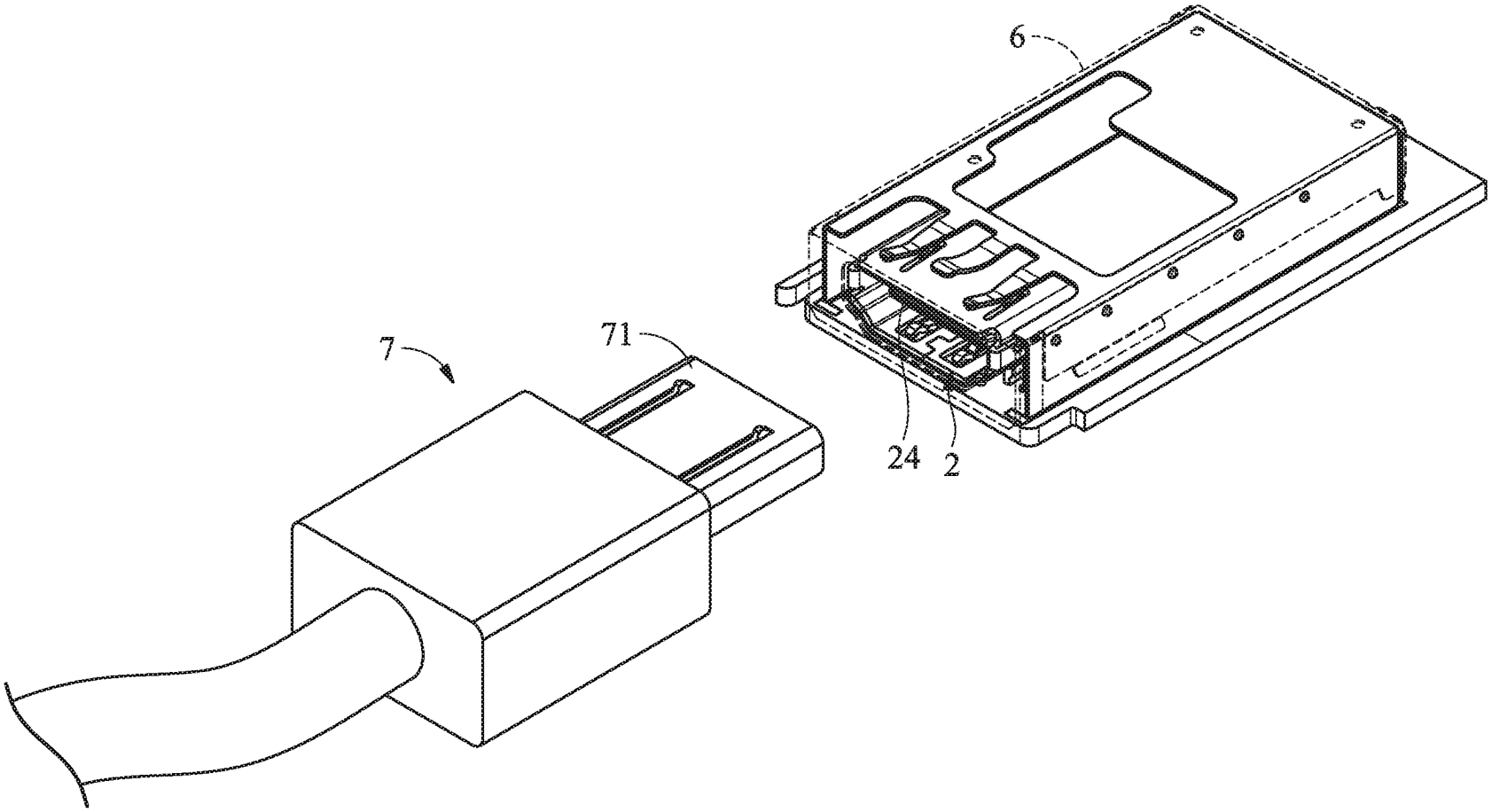
FIG. 1C is an assembling view of the electronic device of the embodiment of the invention.

With reference to FIGS. 1A, 1B and 1C, in one embodiment, the electronic device further comprises an outer cover 6 (shown with dotted line). The outer cover 6 is connected to the ground bracket 3, and the outer cover 6 presses the bracket elastic arm 321 to make the bracket elastic arm 321 abuts the second metal frame elastic arm 232.

With reference to FIG. 1C, in one embodiment, the electronic device E further comprises a connection cable 7. The connection cable 7 comprises a connection joint 71. The connection joint 71 is adapted to be connected to the connector 2. The connector 2 comprises a board 24 and a plurality of connector contacts (not shown). The connector contacts (not shown) are disposed on the board 24. The connector contacts (not shown) are adapted to be electrically connected to the connection joint 71. In one embodiment, the connection joint 71 comprises a plurality of joint contacts (not shown), and the connector contacts (not shown) are adapted to electrically connect the joint contacts (not shown).

In one embodiment, the connector 2 is a high-definition multimedia interface (HDMI) connector.

In the embodiment of the invention, by covering the connector with the ground bracket, the noise of the connector can be reduced. Particularly, the conductive structure couples the metal frame of the connector and the ground bracket, and the resistance between the metal frame and the ground bracket is decreased by the conductive structure. The additional surface current on the metal frame can be conducted to the ground bracket fast, and the noise interference can be reduced. According to experimental result, the electronic device utilizing the embodiment of the invention, the signal attenuation ratio is reduced to 20% from 40%.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term).

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An electronic device, comprising:

a substrate, comprising a ground layer;

a connector, disposed on the substrate, wherein the connector comprises a metal frame;

a ground bracket, affixed on the substrate and coupled to the ground layer, wherein at least a portion of the connector is located in the ground bracket; and a conductive structure, adapted to abut the metal frame and the ground bracket, wherein when the conductive structure connects the metal frame to the ground bracket, the conductive structure electrically connects the ground bracket to the metal frame, wherein the ground bracket comprises at least one ground bracket wall, the metal frame comprises a metal frame lateral side, the ground bracket wall faces the metal frame lateral side, the conductive structure comprises at least one first elastic abutting unit, and when the conductive structure is connected to the metal frame and the ground bracket, the first elastic abutting unit is located between the metal frame and the ground bracket, and the first elastic abutting unit connects the ground bracket wall and the metal frame lateral side at the same time, wherein the metal frame comprises a metal frame bottom side, the metal frame bottom side faces the substrate, the conductive structure comprises a second elastic abutting unit, the second elastic abutting unit is connected to the first elastic abutting unit, and when the conductive structure connects the metal frame to the ground bracket, the second elastic abutting unit is located between the metal frame bottom side and the substrate, the second elastic abutting unit connects to the metal frame bottom side and the substrate at the same time, and the second elastic abutting unit electrically connects the metal frame bottom side to the first elastic abutting unit.

2. The electronic device as claimed in claim 1, wherein the first elastic abutting unit comprises a first abutting portion, a first curved portion and a second abutting portion, the first abutting portion is disposed on one end of the first curved portion, the second abutting portion is disposed on the other end of the first curved portion, and when the first elastic abutting unit is located between the metal frame and the ground bracket, the first abutting portion is connected to the metal frame lateral side, and the second abutting portion is connected to the ground bracket wall.

3. The electronic device as claimed in claim 2, wherein the first elastic abutting unit further comprises a second curved portion, one end of the second abutting portion is connected to the first curved portion, the second curved portion connects the other end of the second abutting portion, the first curved portion forms a first recess, the second curved portion forms a second recess, and the first recess and the second recess face each other.

4. The electronic device as claimed in claim 3, wherein when the conductive structure is separated from the metal frame and the ground bracket, the second curved portion is separated from the first abutting portion, the first curved portion has a first curvature radius, the second curved portion has a second curvature radius, and the second curvature radius is greater than the first curvature radius.

5. The electronic device as claimed in claim 4, wherein when the conductive structure connects the metal frame to the ground bracket, a virtual extension line of the first abutting portion is parallel to a virtual extension line of the second abutting portion.

6. The electronic device as claimed in claim 1, wherein the first elastic abutting unit comprises a first abutting portion, a curved portion, an extending portion and a second abutting portion, the curved portion connects the first abutting portion and the extending portion, the extending portion connects the curved portion to the second abutting portion, the first elastic abutting unit is V-shaped, and when the first elastic abutting unit is located between the metal frame and the ground bracket, the first abutting portion is connected to the metal frame lateral side, and the second abutting portion is connected to the ground bracket wall.

7. The electronic device as claimed in claim 1, wherein the metal frame bottom side comprises at least one first groove and at least one first metal frame elastic arm, the first metal frame elastic arm is in the first groove, the second elastic abutting unit comprises a third abutting portion, a fourth abutting portion and at least one elastic sheet, the third abutting portion connects the fourth abutting portion, the elastic sheet is disposed on the fourth abutting portion, and when the second elastic abutting unit is located between the metal frame bottom side and the substrate, the third abutting portion abuts the substrate, and the elastic sheet is located in the first groove and is adapted to abut the first metal frame elastic arm.

8. The electronic device as claimed in claim 7, wherein when the second elastic abutting unit is located between the metal frame bottom side and the substrate, the fourth abutting portion abuts the metal frame bottom side, the fourth abutting portion has an abutting portion notch, and the elastic sheet is located in the abutting portion notch.

9. The electronic device as claimed in claim 8, wherein the third abutting portion is sheet-shaped, the fourth abutting portion is sheet-shaped, the first elastic abutting unit connects the fourth abutting portion, and a cross section of the second elastic abutting unit is V-shaped.

10. The electronic device as claimed in claim 9, wherein the metal frame has a leaning portion, one side of the leaning portion abuts the substrate, and a top point of the V-shaped second elastic abutting unit abuts the other side of the leaning portion.

11. The electronic device as claimed in claim 7, wherein the first elastic abutting unit comprises a first abutting portion, a first curved portion and a second abutting portion, the first abutting portion is disposed on one end of the first curved portion, the second abutting portion is disposed on the other end of the first curved portion, and when the first elastic abutting unit is located between the metal frame and the ground bracket, the first abutting portion is connected to the metal frame lateral side, and the second abutting portion is connected to the ground bracket wall, wherein the conductive structure is integrally formed.

12. The electronic device as claimed in claim 7, wherein when the second elastic abutting unit is located between the metal frame bottom side and the substrate, the second elastic abutting unit covers the first groove.

13. The electronic device as claimed in claim 7, wherein the metal frame comprises a metal frame top side, the metal frame top side is opposite to the metal frame bottom side, the ground bracket comprises a bracket covering portion, and the bracket covering portion covers at least a portion of the metal frame top side.

14. The electronic device as claimed in claim 13, wherein the metal frame top side comprises at least one second groove and at least one second metal frame elastic arm, the second metal frame elastic arm is located in the second groove, the bracket covering portion comprises a bracket elastic arm, the bracket elastic arm is adapted to abut the second metal frame elastic arm to electrically connect the metal frame to the ground bracket.

15. The electronic device as claimed in claim 14, further comprising an outer cover, wherein the outer cover connects the ground bracket, and the outer cover presses the bracket elastic arm to make the bracket elastic arm abuts the second metal frame elastic arm.

16. The electronic device as claimed in claim 1, further comprising a connection cable, wherein the connection cable comprises a connection joint, the connection joint is adapted to be connected to the connector, the connector comprises a board and a plurality of connector contacts, the connector contacts are disposed on the board, the connection joint comprises a plurality of joint contacts, and the connector contacts are adapted to electrically connect the joint contacts.

17. The electronic device as claimed in claim 1, wherein the connector is a high-definition multimedia interface connector.

* * * * *